United States Patent [19]

Lange

[11] 3,947,253

[45] Mar. 30, 1976

[54] CATALYTIC EXHAUST GAS PURIFICATION DEVICE

[75] Inventor: Karlheinz Lange, Stuttgart, Germany

[73] Assignee: Dr. Ing. h.c.F. Porsche Aktiengesellschaft, Stuttgart, Germany

[22] Filed: Apr. 26, 1974

[21] Appl. No.: 464,984

[30] Foreign Application Priority Data

Apr. 28, 1973 Germany ..... 2321578

[52] U.S. Cl. ..... 23/288 F; 23/288 FB; 23/288 FC

[51] Int. Cl.[2] ..... F01N 3/15; B01J 8/00; B01J 8/02; B01J 8/04

[58] Field of Search ..... 23/288 F, 288 FA, 288 FB, 23/288 FC; 138/43, 45, 46

[56] References Cited

UNITED STATES PATENTS

| | | | |
|---|---|---|---|
| 3,050,935 | 8/1962 | Eastwood | 23/288 F X |
| 3,065,595 | 11/1962 | Gary | 23/288 FC UX |
| 3,086,839 | 4/1963 | Bloch | 23/288 FA X |
| 3,201,206 | 8/1965 | Wawrziniok | 23/288 FA |
| 3,222,140 | 12/1965 | Scivally et al. | 23/288 FA |
| 3,749,130 | 7/1973 | Hourtt et al. | 23/288 FC UX |
| 3,780,772 | 12/1973 | Carnanhan et al. | 23/288 FC UX |

*Primary Examiner*—Barry S. Richman
*Attorney, Agent, or Firm*—Craig & Antonelli

[57] ABSTRACT

A catalytic exhaust gas purification device for internal combustion engines which includes a housing receiving a catalyst and at least one inlet channel and one outlet channel; a baffle element adjustable as a function of the temperature of the catalyst is thereby arranged in the inlet channel upstream of the catalyst. The baffle element is movably mounted within the inlet channel so as to permit the exhaust gas to flow essentially unimpeded toward the center of the catalyst when the catalyst temperature is below a predetermined value and to deflect the exhaust gas away from the center of the catalyst to cause uniform flow thereof to the catalyst when the catalyst temperature is above said predetermined value.

24 Claims, 2 Drawing Figures

CATALYTIC EXHAUST GAS PURIFICATION DEVICE

Figure 1:
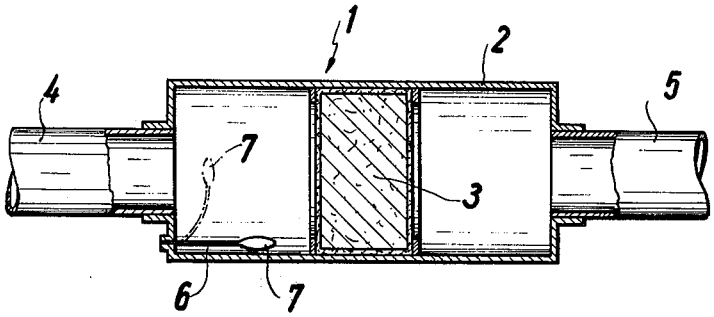

The present invention relates to a catalytic exhaust gas purification installation for internal combustion engines, consisting of a housing receiving a catalyst with at least one inlet and one outlet channel.

Catalytic exhaust gas purification apparatus of the aforementioned type are known (German Auslegeschrift No. 2,045,565), in which a concavely constructed, small protective plate or shield pointing toward the inflowing exhaust gases is arranged in the inlet channel for the protection of the catalyst mass with respect to the very hot exhaust gases flowing against the same, which is fixedly arranged within the area of the axis of symmetry of the catalyst. Even though a uniform attack of the catalyst at high rates of exhaust gas flow is achieved thereby, it has proved as particularly disadvantageous with an installation of this type that as a result of the uniform attack directly after the start of the internal combustion engine, the heat-up phase of the catalyst extends over an undesirably long period of time.

It is the aim of the present invention to provide an installation at the catalyst, by means of which this disadvantage is avoided.

The underlying problems are solved according to the present invention in that a baffle element adjustable in dependence on the temperature of the catalyst is arranged in the inlet channel upstream of the catalyst. It is thereby particularly advantageous that within the low temperature range of the catalyst the baffle element permits the exhaust gases to flow essentially toward the center of the catalyst and at an increased catalyst temperature, the baffle element causes a substantially uniform attack of the catalyst by the exhaust gases. It is thereby possible that the baffle element is arranged at a bimetallic member secured at the housing of the catalyst in such a manner that within the low temperature range of the catalyst, the baffle element is disposed approximately outside of the exhaust gas flow and at increased catalyst temperatures approximately in the center of the exhaust gas flow. A further embodiment according to the present invention resides in that the baffle element is pivotally arranged on a shaft approximately in the center of the exhaust gas flow, whereby the shaft is rotated in such a manner in dependence on the temperature of the catalyst that within the low temperature range of the catalyst the baffle element lies in the flow direction of the exhaust gas stream and at increased catalyst temperature transversely to the exhaust gas flow. The shaft may thereby cooperate, for example, with an adjusting motor which is influenced by a temperature sensor arranged within the area of the catalyst, preferably downstream of the catalyst. The temperature sensor, however, may also be arranged within a space between two catalysts disposed one behind the other within the same catalyst housing with a spacing therebetween. A further embodiment of the present invention resides in that a lever is fixedly arranged on the shaft which cooperates with a bimetallic member arranged within the temperature area of the catalyst.

The advantages achieved by the present invention reside especially in that after the start of the internal combustion engine the exhaust gases are conducted only toward the center of the catalyst by the control according to the present invention of the baffle element whereby a very rapid heat-up of this area of the catalyst takes place and after reaching a predetermined temperature, a uniform attack of the catalyst by the exhaust gases is effected by the baffle element. It is achieved thereby that the catalyst is heated up very rapidly to a temperature, at which it is fully effective so that the exhaust gases which contain a particularly large amount of components harmful to health precisely with a still relatively cool internal combustion engine, are purified relatively early and the length of life of the catalyst is considerably increased by the uniform attack of the catalyst after reaching this temperature.

Figure 2:
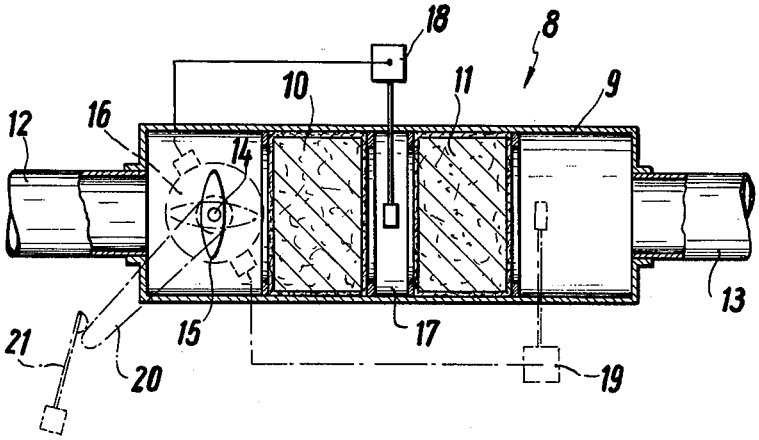

These and further objects, features and advantages of the present invention will become more apparent from the following description when taken in connection with the accompanying drawing which shows, for purposes of illustration only, two embodiments in accordance with the present invention, and wherein:

FIG. 1 is a longitudinal axial cross-sectional view through a catalytic reactor with a baffle element pivotally arranged in the inlet channel according to the present invention; and FIG. 2 is a longitudinal axial cross-sectional view through a modified embodiment of a catalytic reactor with a baffle element rotatably arranged in the inlet channel according to the present invention.

Referring now to the drawing and more particularly to FIG. 1, the catalyst pot is generally designated in this figure by reference numeral 1 while the housing of the catalyst is designated by reference numeral 2 and the catalyst (monolith or bulk material) is designated by reference numeral 3. The housing 2 includes an inlet channel 4 and a discharge channel 5 for the exhaust gases. A bimetallic member 6 is secured at the housing 2 within the area of the inlet channel 4, at which is arranged at one end thereof a baffle element 7 of any desired shape, preferably of flat, oval shape which is appropriately perforated.

If an internal combustion engine (not shown) is started, then the bimetallic member 6 together with the baffle element 7 assumes the position illustrated in full line. As a result thereof, the exhaust gases are conducted toward the center of the catalyst 3 whereby the latter is heated up rapidly to a temperature, at which the catalyst 3 becomes fully effective. The heat resulting thereby within the area upstream of the catalyst 3 effects a pivoting or deflection of the bimetallic member 6 and of the baffle element 7 secured thereon into the position shown in dash and dot lines so that the exhaust gases at first impinge against the baffle element 7 and a uniform attack of the catalyst 3 by the exhaust gases is achieved thereby, i.e., the catalyst 3 is acted upon substantially uniformly throughout its cross section by the exhaust gases.

In FIG. 2, the catalyst pot is generally designated by reference numeral 8, while the housing is designated by reference numeral 9 and the catalysts arranged in series one behind the other within the housing 9 are designated by reference numerals 10 and 11. The housing 9 includes an inlet channel 12 and a discharge channel 13 for the exhaust gases. The baffle element 15 is rotatably arranged in the exhaust gas flow on a shaft 14 within the area of the inlet channel 12 upstream of the catalyst 10. This shaft 14 either cooperates with an adjusting motor 16 which is controlled by a temperature sensor arranged in the space 17 between the catalysts 10 and 11 and/or is controlled by a temperature sensor 19 arranged in the discharge flow downstream of the catalyst, or is provided with a lever 20 which cooperates with a bimetallic member 21 arranged within the temperature range of the catalytic reactor 8, i.e., within the area affected by the temperature of the catalytic reactor 8.

If the internal combustion engine (not shown) is started, then the baffle element 15 assumes the position indicated in dash and dot lines. The exhaust gases are thereby conducted toward the centers of the catalysts 10 and 11 whereby the latter are heated up rapidly to a temperature, at which the catalysts 10 and 11 become effective. If the baffle element 15 cooperates with the adjusting motor 16, then the baffle element 15 is pivoted or rotated at a predetermined temperature within the catalytic reactor 8, controlled by the temperature sensor 18 and/or 19, by the adjusting motor 16 into the position shown in full line. It is thereby also feasible within the scope of the present invention to utilize a unitary catalyst and to arrange a temperature sensor downstream of such unitary, one-piece catalyst. If the shaft 14 is provided with the lever 20, then the baffle element 15 is rotated or pivoted into the position shown in full lines by way of the lever 20 by the bimetallic member 21 arranged at any suitable place within the direct influence area of the temperature of the catalytic reactor so that the exhaust gases then impinge at first against the baffle element 15 and a uniform attack of the catalysts 10 and 11 by the exhaust gases is achieved thereby, i.e., the catalysts 10 and are acted upon substantially uniformly over their cross section by the exhaust gases.

In accordance with the present invention, as shown in the drawings, the baffle means may have an essentially flat configuration. Also, if desired the baffle means may have a cross-sectional area at least approximately corresponding to the cross-sectional area of the catalyst means in a plane transversely to the flow axis of the gases. In addition, the baffle means may have an essentially oval cross-section as viewed in a plane substantially parallel to the flow axis of the exhaust gases.

While I have shown and described two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A catalytic exhaust gas purification device for internal combustion engines which includes a housing means having at least one inlet channel means and one discharge channel means and accommodating a first catalyst means, further comprising a baffle means including a baffle element and means for moving said baffle element, in dependence on an increase in the temperature of the catalyst means, between a first position wherein said baffle element lies substantially in a plane which is substantially parallel to the flow direction of said exhaust gases thereby permitting the exhaust gas to flow essentially unimpeded toward the center of the catalyst means and a second position wherein said baffle element lies substantially in a plane substantially perpendicular to the flow direction of said exhaust gas whereby said baffle element deflects the exhaust gas away from the center of the catalyst means causing substantially uniform attack of the catalyst means by the exhaust gas.

2. A catalytic exhaust gas purification device according to claim 1, characterized in that the baffle element has an essentially oval cross-section as viewed in a plane substantially parallel to the flow axis of the exhaust gases.

3. A catalytic exhaust gas purification device according to claim 1, characterized in that the baffle element has a cross-sectional area at least approximately corresponding to the cross-sectional area of the catalyst means in a plane transversely to the flow axis of the gases.

4. A catalytic exhaust gas purification device according to claim 1, characterized in that the baffle element further includes a bimetallic means within said housing means and secured at one end thereof to said housing means and at the other end thereof to said baffle element, said bimetallic means positioning said baffle element in said first position when said catalyst temperature is below a predetermined value and in said second position when said catalyst temperature exceeds said predetermined value.

5. A catalytic exhaust gas purification device according to claim 1 further comprising sensing means for controlling the action of said means for moving said baffle element in response to the temperature of said catalyst means.

6. A catalyst exhaust gas purification device according to claim 1, wherein said catalyst means is constructed and arranged in said housing such that exhaust gas passes through said catalyst bed in the axial direction only.

7. A catalyst exhaust gas purification device according to claim 6, wherein the catalyst means is so constructed and arranged in said housing that the surface of said catalyst means impinged by said exhaust gas is substantially perpendicular to the flow direction of said exhaust gas.

8. A catalytic exhaust gas purification device according to claim 7, wherein the cross-sectional area of the surface of said catalyst means impinged by said exhaust gas is larger than the cross-sectional area of the opening in said inlet channel means.

9. A catalytic exhaust gas purification device according to claim 1, characterized in that the baffle element is rotatably arranged on a shaft approximately in the center of the exhaust gas stream, said baffle means including means for rotating said shaft in dependence on the temperature of the catalyst means in such a manner that said baffle element is disposed essentially in the flow direction of the exhaust gas stream within a low temperature range of the catalyst means and is disposed substantially transversely to the exhaust gas stream at increased catalyst temperatures.

10. A catalytic exhaust gas purification device according to claim 9, wherein said baffle means includes a lever means fixedly arranged on the shaft which cooperates with a bimetal temperature sensing means arranged within the temperature area affected by the catalyst means.

11. A catalytic exhaust gas purification device according to claim 9, wherein said means for rotating said shaft includes motor means operatively connected to a temperature sensor means arranged within the area of the catalyst means.

12. A catalytic exhaust gas purification device according to claim 11, wherein said temperature sensor means is arranged downstream of the catalyst means.

13. A catalytic exhaust gas purification device according to claim 11, further including a second catalyst means disposed within the housing means, said second catalyst means being located downstream of said first catalyst means and spaced therefrom, said temperature sensor means being located in the space between said first and second catalyst means.

14. A catalytic exhaust gas purification device according to claim 1, characterized in that the baffle element has an essentially flat configuration.

15. A catalytic exhaust gas purification device according to claim 14, characterized in that the baffle element has a cross-sectional area at least approximately corresponding to the cross-sectional area of the catalyst means in a plane transversely to the flow axis of the gases.

16. A catalytic exhaust gas purification device according to claim 15, characterized in that the baffle element has an essentially oval cross-section as viewed in a plane substantially parallel to the flow axis of the exhaust gases.

17. A catalytic exhaust gas purification device according to claim 14, wherein said baffle means is arranged inside said housing means.

18. A catalytic exhaust gas purification device according to claim 17, wherein said baffle element is mounted on one end of a bimetallic element, the other end of said bimetallic element being mounted on said housing.

19. A catalytic exhaust gas purification device according to claim 17, wherein said baffle element is mounted on a shaft capable of rotating said baffle element between said first position and said second position.

20. A catalytic exhaust gas purification device according to claim 19, wherein said shaft is arranged approximately in the center of the exhaust gas stream, wherein said baffle element is an elongated baffle element, and wherein said elongated baffle element is disposed by said shaft essentially in the flow direction of the exhaust gas stream within a low temperature range of the catalyst means and is disposed by said shaft substantially transversely to the exhaust gas stream at increased catalyst temperatures.

21. A catalytic exhaust gas purification device according to claim 19 further comprising sensing means for controlling the action of said means for moving said baffle element in response to the temperature of said catalyst means.

22. A catalytic exhaust gas purification device for internal combustion engines comprising a housing means having at least one inlet opening and at least one discharge opening, a catalyst means arranged in said housing so that exhaust gas passes through said catalyst means in the axial direction, and baffle means including a baffle element and means for moving said baffle element, in dependence on the temperature of the catalyst means, between a first position wherein said baffle element lies substantially in a plane substantially parallel to the flow direction of said exhaust gas thereby permitting the exhaust gas to flow essentially unimpeded toward the center of the catalyst means and a second position wherein said baffle element lies substantially in a plane substantially perpendicular to the flow direction of said exhaust gas whereby said baffle element deflects the exhaust gas away from the center of the catalyst means causing substantially uniform attack of the catalyst means by the exhaust gas.

23. A catalytic exhaust gas purification device according to claim 22, wherein said catalyst means is constructed and arranged in said housing so that the surface of the catalyst means impinged by said exhaust gas is arranged perpendicular to the flow direction of said exhaust gas.

24. A catalytic exhaust gas purification device according to claim 23, wherein the cross-sectional area of the surface of said catalyst means impinged by said exhaust gas is larger than the cross-sectional area of said at least one inlet opening.

* * * * *